US006752049B1

(12) United States Patent
White

(10) Patent No.: US 6,752,049 B1
(45) Date of Patent: Jun. 22, 2004

(54) SECURITY FASTENER REMOVING KIT

(76) Inventor: Thomas White, 16340 Camelones Dr., Hacienda Heights, CA (US) 91745

( * ) Notice: Subject to any disclaimer, the term of this patent is extended or adjusted under 35 U.S.C. 154(b) by 77 days.

(21) Appl. No.: 10/072,287

(22) Filed: Feb. 11, 2002

(51) Int. Cl.[7] ..... B25B 23/00
(52) U.S. Cl. ..... 81/461; 81/53.2; 81/436
(58) Field of Search ..... 81/461, 460, 436, 81/439, 441, 447, 451, 53.2, 176.15, 488; D8/82, 86, 387

(56) References Cited

U.S. PATENT DOCUMENTS 173,356 A * 2/1876 Sloan ..... 81/461
260,795 A * 7/1882 Smith ..... 411/407
1,824,624 A * 9/1931 Robertson ..... 81/439
2,670,639 A * 3/1954 Flowers et al. ..... 408/54
2,684,526 A * 7/1954 Hoover ..... 29/426.6
3,073,206 A * 1/1963 Rudolph ..... 411/410
3,608,596 A * 9/1971 Yoho ..... 81/451
3,673,912 A * 7/1972 Herr ..... 411/403
3,985,170 A * 10/1976 Iskra ..... 81/438
4,026,338 A * 5/1977 Goebel ..... 81/441
4,831,902 A * 5/1989 McClure ..... 81/53.2
5,450,776 A * 9/1995 Kozak ..... 81/451
5,865,078 A * 2/1999 Langford ..... 81/441
6,077,267 A * 6/2000 Huene ..... 606/73

* cited by examiner

*Primary Examiner*—Joseph J. Hail, III
*Assistant Examiner*—David B. Thomas

(57) ABSTRACT

A security fastener removing kit for removing security fasteners designed for only turning in a clockwise or tightening direction. The security fastener removing kit includes boring at least one hole in a head of a security fastener. A tool member is provided that has at least one tine that is removably insertable in the hole in the head of the security fastener. The tool member permits a user to rotate the head of the security fastener in at least a counterclockwise direction thereby unfastening the security fastener.

4 Claims, 3 Drawing Sheets

SECURITY FASTENER REMOVING KIT

BACKGROUND OF THE INVENTION

1. Field of the Invention

The present invention relates to fastener removing kits and more particularly pertains to a new security fastener removing kit for removing security fasteners designed for only turning in a clockwise or tightening direction.

2. Description of the Prior Art

The use of fastener removing kits is known in the prior art. More specifically, fastener kits heretofore devised and utilized are known to consist basically of familiar, expected and obvious structural configurations.

Known prior art includes U.S. Pat. No. 4,197,889; U.S. Pat. No. 3,985,170; U.S. Pat. No. 2,161,095; U.S. Pat. No. 2,808,862; U.S. Pat. No. 4,204,308; and U.S. Pat. No. Des. 256,442.

Security fasteners have been designed to rotate only in a clockwise direction thereby preventing the unfastening of an object from another object. However, the very purpose of security fasteners, to rotate in only a clockwise direction, makes it difficult for a user who decides or must unfasten the objects fastened together by the security fastener. The difficulty of unfastening security fasteners has resulted in several devices and methods of removing security fasteners. For example, screwdriver type tools have been invented that are insertable in specially designed security fasteners. The only way to remove the security fastener is with the specially designed tool. These types of devices are often sold as a kit.

Some security fasteners are not sold with a specially designed tool leaving a user to attempt removal of the security fastener by other means. Removal of a security fastener without a special tool often requires removal of a head of the security fastener, which cannot be usually done without damaging a surface of the object holding the security fastener. The present invention provides a kit designed to remove a security fastener without damaging the object being secured by the security fastener.

SUMMARY OF THE INVENTION

In view of the foregoing disadvantages inherent in the known types of fastener kits now present in the prior art, the present invention provides a new security fastener removing kit construction wherein the same can be utilized for removing security fasteners designed for only turning in a clockwise or tightening direction.

The general purpose of the present invention, which will be described subsequently in greater detail, is to provide a new security fastener removing kit which has many of the advantages of the fastener kits mentioned heretofore and many novel features that result in a new security fastener removing kit which is not anticipated, rendered obvious, suggested, or even implied by any of the prior art fastener kits, either alone or in any combination thereof.

While these devices fulfill their respective, particular objectives and requirements, the aforementioned patents do not disclose a new security fastener removing kit. The inventive device includes a means of boring at least one hole in a head of a security fastener. A tool member is provided that has at least one tine that is removably insertable in the hole in the head of the security fastener. The tool member permits a user to rotate the head of the security fastener in at least a counterclockwise direction thereby unfastening the security fastener.

An object of the present invention is to provide a new security fastener removing kit for removing security fasteners designed for only turning in a clockwise or tightening direction.

Another object of the present invention is to provide a new security fastener removing kit that permits a user to remove a security fastener without damaging the object being fastened.

Still another object of the present invention is to provide a new security fastener removing kit that permits a user unfamiliar with methods of removing a security fastener to more quickly and safely remove a security fastener.

There has thus been outlined, rather broadly, the more important features of the security fastener removing kit in order that the detailed description thereof that follows may be better understood, and in order that the present contribution to the art may be better appreciated.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. It is important, therefore, that the claims be regarded as including such equivalent constructions insofar as they do not depart from the spirit and scope of the present invention.

BRIEF DESCRIPTION OF THE DRAWINGS

The drawings of the preferred embodiment annexed herein include.

DESCRIPTION OF THE PREFERRED EMBODIMENT

Figure 1:
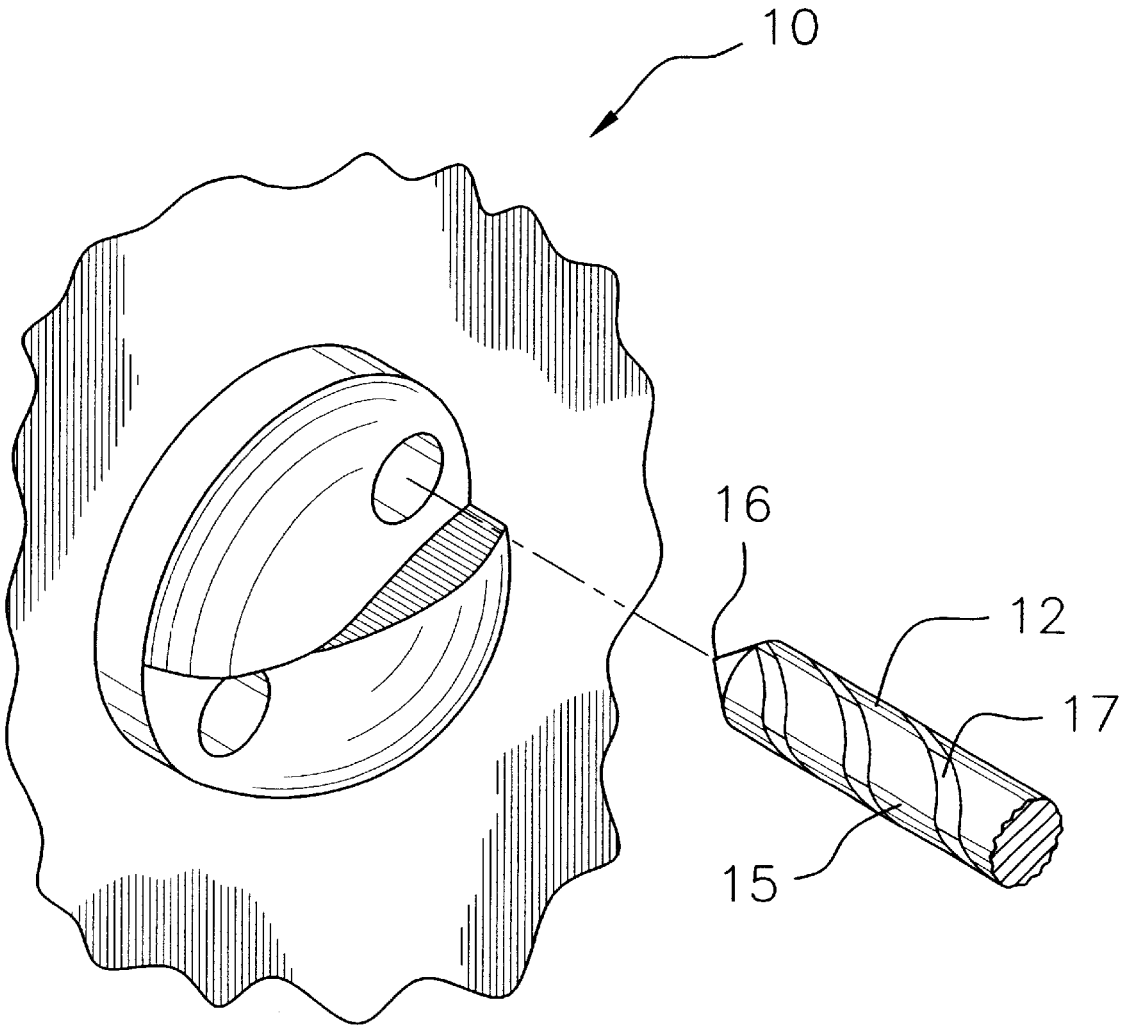
FIG. 1 is a perspective view of a new security fastener removing kit according to the present invention.
Figure 2:
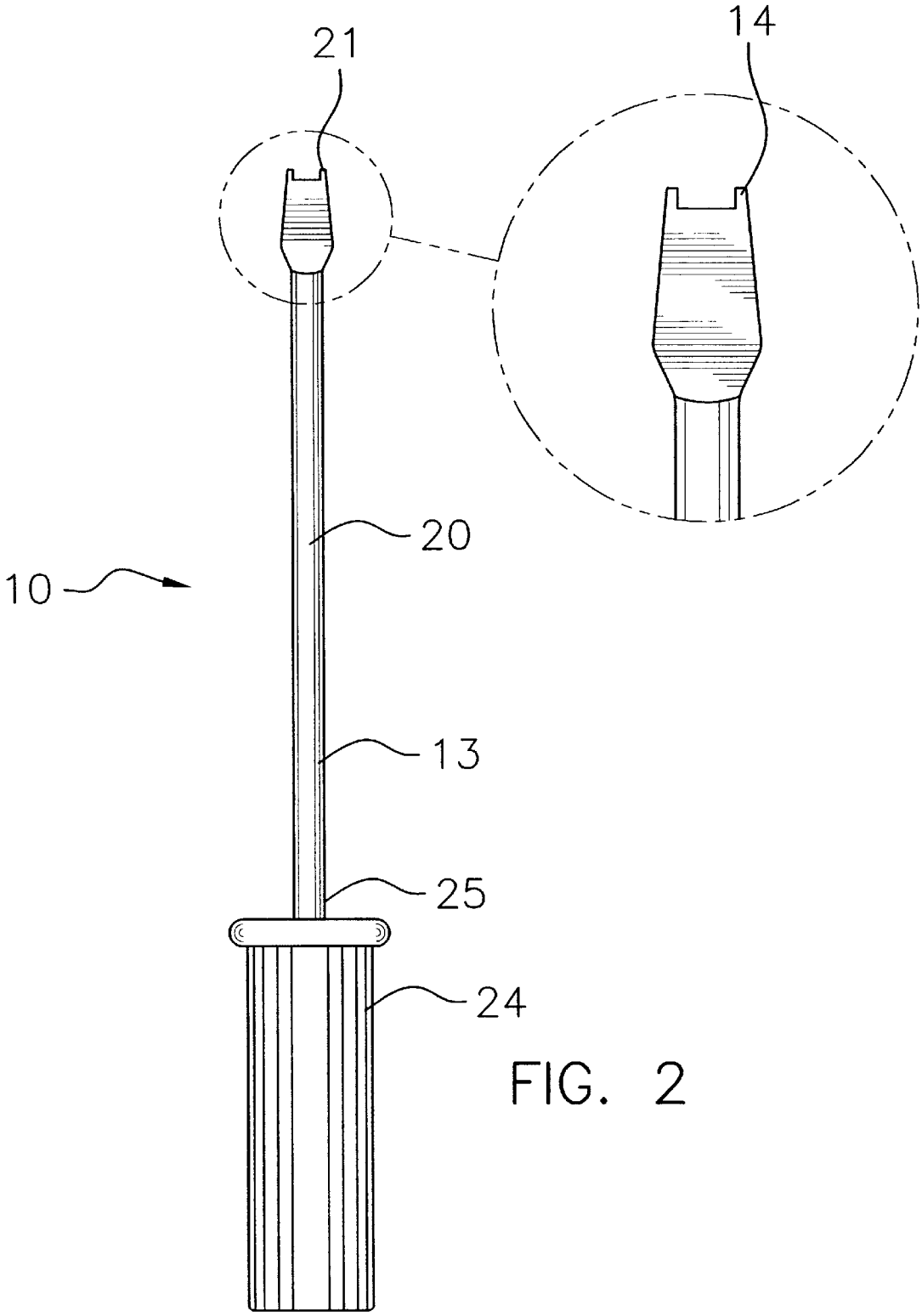
FIG. 2 is a side elevational view of the present invention.
Figure 3:
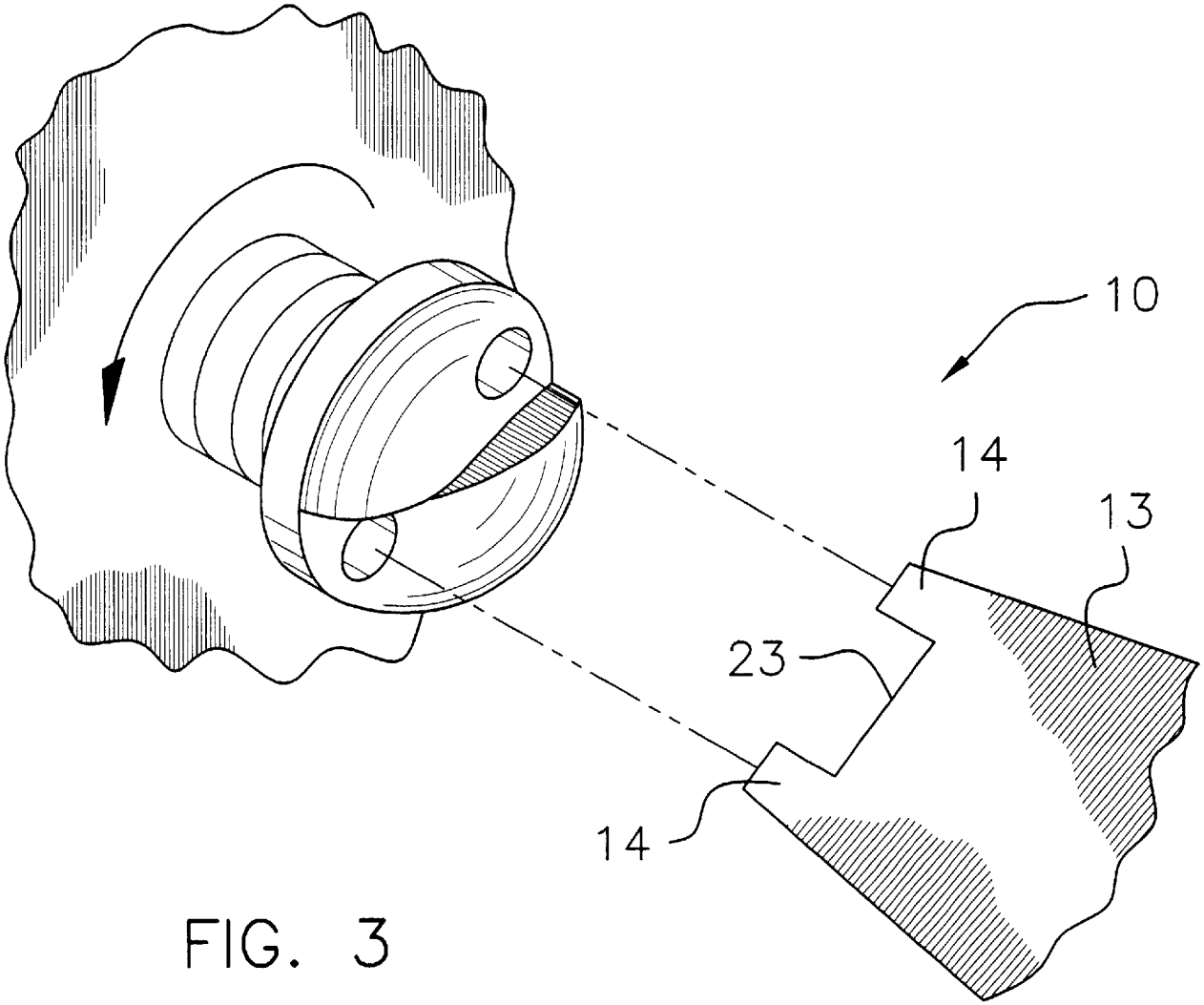
FIG. 3 is a perspective view of the present invention.

Referring to FIGS. 1–3, a new security fastener removing kit is designated by the reference numeral 10. The security fastener removing kit 10 generally comprises a means of boring 12 at least one hole in a head of a security fastener and a tool member 13 that has at least one tine 14 that is removably insertable in the hole in the head of the security fastener. The tool member 13 permits a user to rotate the head of the security fastener in at least a counterclockwise direction.

The means of boring 12 may include a shaft 15 that has a generally pointed end 16. The means of boring 12 may also include a helical channel 17 extending into and about the shaft 15. A pair of edges defines the helical channel 17, which permits the means of boring 12 to cut into the head of the security fastener. In one embodiment of the present invention, the means of boring 12 may comprise a drill bit. However, other means of boring 12 may also be employed.

The tool member 13 may include a shaft 20 that has a first end 21 and a second end. The tine 14 may extend away from the first end 21 of the tool member 13. The tine 14 may include a longitudinal axis that is parallel to a longitudinal axis of the shaft 20 of the tool member 13.

In one embodiment of the present invention, as particularly illustrated in FIGS. 2 and 3, the at least one tine 14 includes a pair of spaced tines. A notch 23 may extend into the first end 21 of the shaft 20 defining the pair of spaced tines 14. Each of the tines 14 may be removably insertable in a pair of holes extending into the head of the security fastener. As illustrated in FIG. 2, a width of the shaft 20 may widen from the first end 21 toward the second end of the shaft 20.

A handle 24 may be mounted on a second end 25 of the shaft 20 for receiving a hand of a user. The handle 24 may include a plurality of longitudinal ridges for gripping a hand of a user turning the handle 24 to rotate the shaft 20 and the security fastener. The handle 24 may comprise a substantially rigid material such as, for example, a plastic material. However, other materials may also be employed in the manufacture of the handle 24.

In one embodiment of the present invention, the shaft 20 may have a generally hexagonal transverse cross section taken substantially perpendicular to a longitudinal axis of the shaft. However, the shaft 20 may employ any shaped transverse cross section.

In use, the means of boring 12 at least one hole in a head of a security fastener is positioned against the head of the security fastener. The means of boring 12 may then be rotated to bore the hole therein. In the embodiment employing a pair of tines, a pair of spaced holes may be bored into the head of the security fastener.

The tines 14 of the tool member 13 are then inserted into the hole or holes. The user then rotates the tool member 13 in a counterclockwise direction, wherein the security fastener rotates in a counterclockwise direction such that it becomes unfastened.

Although the present invention has been discussed with reference to particular embodiments it will be understood that other variations and modifications to the discussed embodiments is possible without departing from the scope of the present invention.

I claim:

1. A security fastener removing kit, the security fastener having a head adapted to permit a user to only rotate the security fastener in a clockwise rotation, said kit comprising:

a means of boring at least one hole in a head of a security fastener; and;

a tool member having at least one tine being removably insertable in said at least one hole in the head of the security fastener for permitting a user to rotate the head of the security fastener in at least a counterclockwise direction, wherein said tool member includes a shaft having a first end, said first end of said shaft having said at least one tine integral to and extending away therefrom, said shaft having a generally planar surface adjacent to said at least one tine for easier access to said at least one hole in the head of the security fastener.

2. The security fastener removing kit of claim 1, wherein said at least one tine includes a pair of spaced tines, a notch extending into said first end of said shaft defining said pair of spaced tines, each of said tines being removably insertable in a pair of holes extending into the head of the security fastener.

3. The security fastener removing kit of claim 1, wherein a width of said shaft widens from said first end toward said second end of said shaft.

4. The security fastener removing kit of claim 2, additionally including a handle being mounted on a second end of said shaft for receiving a hand of a user.

* * * * *